US009534471B2

(12) United States Patent
Etzel

(10) Patent No.: US 9,534,471 B2
(45) Date of Patent: Jan. 3, 2017

(54) MULTIZONE TREATMENT SYSTEM

(75) Inventor: Ethan Etzel, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 808 days.

(21) Appl. No.: 13/250,115

(22) Filed: Sep. 30, 2011

(65) Prior Publication Data

US 2013/0081827 A1 Apr. 4, 2013

(51) Int. Cl.

| | |
|---|---|
| ***E21B 23/08*** | (2006.01) |
| ***E21B 34/14*** | (2006.01) |
| ***E21B 43/14*** | (2006.01) |
| *E21B 34/00* | (2006.01) |

(52) U.S. Cl.

CPC ..... *E21B 34/14* (2013.01); *E21B 43/14* (2013.01); *E21B 2034/007* (2013.01)

(58) Field of Classification Search

CPC ..... E21B 23/08; E21B 34/10; E21B 43/14; E21B 34/14; E21B 21/103

USPC ..... 166/193, 318, 153

See application file for complete search history.

(56) References Cited

U.S. PATENT DOCUMENTS

| | | | | |
|---|---|---|---|---|
| 3,011,548 A | | 12/1961 | Holt | |
| 3,054,415 A | | 9/1962 | Baker et al. | |
| 3,228,473 A | * | 1/1966 | Baker | 166/154 |
| 3,263,752 A | | 8/1966 | Conrad | |
| 3,269,463 A | | 8/1966 | Page, Jr. | |
| 3,995,692 A | | 12/1976 | Seitz | |
| 4,043,392 A | * | 8/1977 | Gazda | 166/217 |
| 4,064,937 A | | 12/1977 | Barrington | |
| 4,067,388 A | * | 1/1978 | Mouret et al. | 166/208 |
| 4,355,686 A | | 10/1982 | Arendt | |
| 4,729,432 A | | 3/1988 | Helms | |
| 4,771,831 A | | 9/1988 | Pringle et al. | |
| 5,183,114 A | | 2/1993 | Mashaw, Jr. et al. | |

(Continued)

FOREIGN PATENT DOCUMENTS

| | | |
|---|---|---|
| WO | 03095794 A1 | 11/2003 |
| WO | 2004088091 A1 | 10/2004 |

OTHER PUBLICATIONS

Thomson, D. W., and Nazroo, M. F., Design and Installation of a Cost-Effective Completion System for Horizontal Chalk Wells Where Multiple Zones Require Acid Stimulation, SPE 51177 (a revision of SPE 39150), Offshore Technology Conference, May 1997, Houston, TX, USA.

(Continued)

*Primary Examiner* — Kipp Wallace
(74) *Attorney, Agent, or Firm* — Jeffery R. Peterson

(57) ABSTRACT

A technique provides a system and methodology for treating a plurality of zones, e.g. well zones. A plurality of flow control devices is located along a tubular structure, such as a well string in a wellbore. Each flow control device comprises a seat member with an annularly located recess having a unique profile relative to the annularly located recesses of the other flow control devices. Darts are designed with engagement features sized to correspond with selected annularly located recesses. Each dart may have an engagement feature of a specific length designed to engage the corresponding recess of a specific flow control device to enable actuation of that flow control device once the dart is dropped through the tubular structure.

16 Claims, 3 Drawing Sheets

(56) References Cited

U.S. PATENT DOCUMENTS

| | | | | |
|---|---|---|---|---|
| 5,224,044 | A | 6/1993 | Tamura et al. | |
| 5,295,393 | A | 3/1994 | Thiercelin | |
| 5,333,692 | A | 8/1994 | Baugh et al. | |
| 5,526,888 | A | 6/1996 | Gazewood | |
| 5,921,318 | A | 7/1999 | Ross | |
| 5,988,285 | A | 11/1999 | Tucker et al. | |
| 6,006,838 | A | 12/1999 | Whiteley et al. | |
| 6,059,032 | A | 5/2000 | Jones | |
| 6,155,342 | A | 12/2000 | Oneal et al. | |
| 6,189,618 | B1 * | 2/2001 | Beeman et al. | 166/312 |
| 6,206,095 | B1 | 3/2001 | Baugh | |
| 6,216,785 | B1 | 4/2001 | Achee, Jr. et al. | |
| 6,302,199 | B1 | 10/2001 | Hawkins et al. | |
| 6,334,486 | B1 | 1/2002 | Carmody et al. | |
| 6,371,208 | B1 | 4/2002 | Norman et al. | |
| 6,443,228 | B1 | 9/2002 | Aronstam et al. | |
| 6,543,538 | B2 | 4/2003 | Tolman et al. | |
| 6,634,429 | B2 | 10/2003 | Henderson et al. | |
| 6,907,936 | B2 | 6/2005 | Fehr et al. | |
| 6,997,263 | B2 | 2/2006 | Campbell et al. | |
| 7,066,265 | B2 | 6/2006 | Surjaatmadja | |
| 7,093,664 | B2 | 8/2006 | Todd et al. | |
| 7,108,067 | B2 | 9/2006 | Themig et al. | |
| 7,134,505 | B2 | 11/2006 | Fehr et al. | |
| 7,168,494 | B2 | 1/2007 | Starr et al. | |
| 7,210,533 | B2 | 5/2007 | Starr et al. | |
| 7,322,417 | B2 | 1/2008 | Rytlewski et al. | |
| 7,325,617 | B2 | 2/2008 | Murray | |
| 7,353,879 | B2 | 4/2008 | Todd et al. | |
| 7,377,321 | B2 | 5/2008 | Rytlewski | |
| 7,387,165 | B2 | 6/2008 | Lopez de Cardenas et al. | |
| 7,431,091 | B2 | 10/2008 | Themig et al. | |
| 7,464,764 | B2 | 12/2008 | Xu | |
| 7,490,669 | B2 | 2/2009 | Walker et al. | |
| 7,522,779 | B2 | 4/2009 | Fu et al. | |
| 7,543,634 | B2 | 6/2009 | Fehr et al. | |
| 7,543,647 | B2 | 6/2009 | Walker | |
| 7,571,765 | B2 | 8/2009 | Themig | |
| 7,575,062 | B2 | 8/2009 | East, Jr. | |
| 7,661,481 | B2 | 2/2010 | Todd et al. | |
| 7,748,460 | B2 | 7/2010 | Themig et al. | |
| 7,832,472 | B2 | 11/2010 | Themig | |
| 7,878,257 | B2 * | 2/2011 | Chen et al. | 166/386 |
| 7,891,774 | B2 | 2/2011 | Silverbrook | |
| 8,469,109 | B2 * | 6/2013 | Wang et al. | 166/386 |
| 2003/0180094 | A1 | 9/2003 | Madison | |
| 2004/0118564 | A1 | 6/2004 | Themig et al. | |
| 2004/0262016 | A1 | 12/2004 | Farquhar | |
| 2005/0039916 | A1 * | 2/2005 | Schultz et al. | 166/285 |
| 2006/0124310 | A1 | 6/2006 | Lopez de Cardenas et al. | |
| 2006/0207764 | A1 | 9/2006 | Rytlewski | |
| 2006/0243455 | A1 | 11/2006 | Telfer et al. | |
| 2007/0044958 | A1 | 3/2007 | Rytlewski et al. | |
| 2007/0107908 | A1 | 5/2007 | Vaidya et al. | |
| 2007/0181224 | A1 | 8/2007 | Marya et al. | |
| 2007/0272413 | A1 | 11/2007 | Rytlewski et al. | |
| 2007/0284097 | A1 | 12/2007 | Swor et al. | |
| 2008/0105438 | A1 | 5/2008 | Jordan et al. | |
| 2008/0210429 | A1 | 9/2008 | McMillin et al. | |
| 2009/0026081 | A1 | 1/2009 | Bjellqvist et al. | |
| 2009/0065216 | A1 * | 3/2009 | Frazier | E21B 34/063 166/373 |
| 2009/0260814 | A1 | 10/2009 | Malone | |
| 2010/0065125 | A1 | 3/2010 | Telfer | |
| 2010/0101803 | A1 | 4/2010 | Clayton et al. | |
| 2010/0132954 | A1 | 6/2010 | Telfer | |
| 2010/0209288 | A1 | 8/2010 | Marya | |
| 2011/0056692 | A1 | 3/2011 | Lopez de Cardenas et al. | |
| 2011/0127047 | A1 | 6/2011 | Themig et al. | |
| 2011/0278010 | A1 | 11/2011 | Fehr et al. | |
| 2012/0085538 | A1 | 4/2012 | Guerrero et al. | |
| 2013/0168098 | A1 * | 7/2013 | Campbell et al. | 166/308.1 |

OTHER PUBLICATIONS

Lonnes, S. B., Nygaard, K. J., Sorem, W. A., Hall, T. J., Tolman, R. C., Advanced Multizone Stimulation Technology, SPE 95778, Presented at the 2005 SPE Annual Technical Conference and Exhibition, Oct. 9-12, 2005, Dallas, TX, USA.

Rytlewski, G., Multiple-Layer Commpletions for Efficient Treatment of Multilayer Reservoirs, IADC/SPE 112476, Presented at the 2008 IADC/SPE Drilling Conference, Mar. 4-6, 2008, Orlando, FL, USA.

GCC Application No. GC 2012-22388, Examination Report dated Mar. 12, 2015, 4 pgs.

PCT/US2012/055837, International Search Report and Written Opinion, dated Feb. 25, 2013, 8 pgs.

* cited by examiner

MULTIZONE TREATMENT SYSTEM

BACKGROUND

Hydrocarbon fluids are obtained from subterranean geologic formations, referred to as reservoirs, by drilling wells that penetrate the hydrocarbon-bearing formations. In some applications, a well is drilled through multiple well zones and each of those well zones may be treated to facilitate hydrocarbon fluid productivity. For example, a multizone vertical well or horizontal well may be completed and stimulated at multiple injection points along the well completion to enable commercial productivity. The treatment of multiple zones can be achieved by sequentially setting bridge plugs through multiple well interventions. In other applications, drop balls are used to open sliding sleeves at sequential well zones with size-graduated drop balls designed to engage seats of progressively increasing diameter.

SUMMARY

In general, the present disclosure provides a system and method for treating a plurality of zones, e.g. well zones. A plurality of flow control devices is located along a tubular structure, such as a well string in a wellbore. Each flow control device comprises a seat member with an annularly located recess having a unique profile, e.g. axial length, relative to the annularly located recesses of the other flow control devices. Darts are designed with engagement features sized to correspond with selected annularly located recesses. For example, each dart may have an engagement feature of a specific profile, e.g. length, designed to engage the corresponding recess of a specific flow control device to enable actuation of that flow control device once the dart is dropped through the tubular structure.

BRIEF DESCRIPTION OF THE DRAWINGS

Certain embodiments will hereafter be described with reference to the accompanying drawings, wherein like reference numerals denote like elements. It should be understood, however, that the accompanying figures illustrate only the various implementations described herein and are not meant to limit the scope of various technologies described herein, and.

DETAILED DESCRIPTION

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology which facilitate multi-zonal treatment along a tubular structure. For example, the system and methodology may be used to facilitate the treatment of a plurality of well zones located along a wellbore drilled through a subterranean formation. Depending on the application, the wellbore may be vertical and/or deviated, e.g. horizontal, and may extend through multiple well zones. The individual well zones can be subjected to a variety of well treatments to facilitate production of desired hydrocarbon fluids, such as oil and/or gas. The well treatments may comprise stimulation treatments, such as fracturing treatments, performed at the individual well zones. However, a variety of other well treatments may be employed utilizing various types of treatment materials, including fracturing fluid, proppant materials, slurries, chemicals, and other treatment materials designed to enhance the productivity of the well.

Also, the well treatments may be performed in conjunction with many types of well equipment deployed downhole into the wellbore. For example, various completions may employ a variety of flow control devices which are used to control the lateral flow of fluid out of and/or into the completion at the various well zones. In some applications, the flow control devices are mounted along a well casing to control the flow of fluid between an interior and exterior of the well casing. However, flow control devices may be positioned along internal tubing or along other types of well strings/tubing structures deployed in the wellbore. The flow control devices may comprise sliding sleeves, valves, and other types of flow control devices which may be actuated by a member dropped down through the tubular structure.

Figure 1:
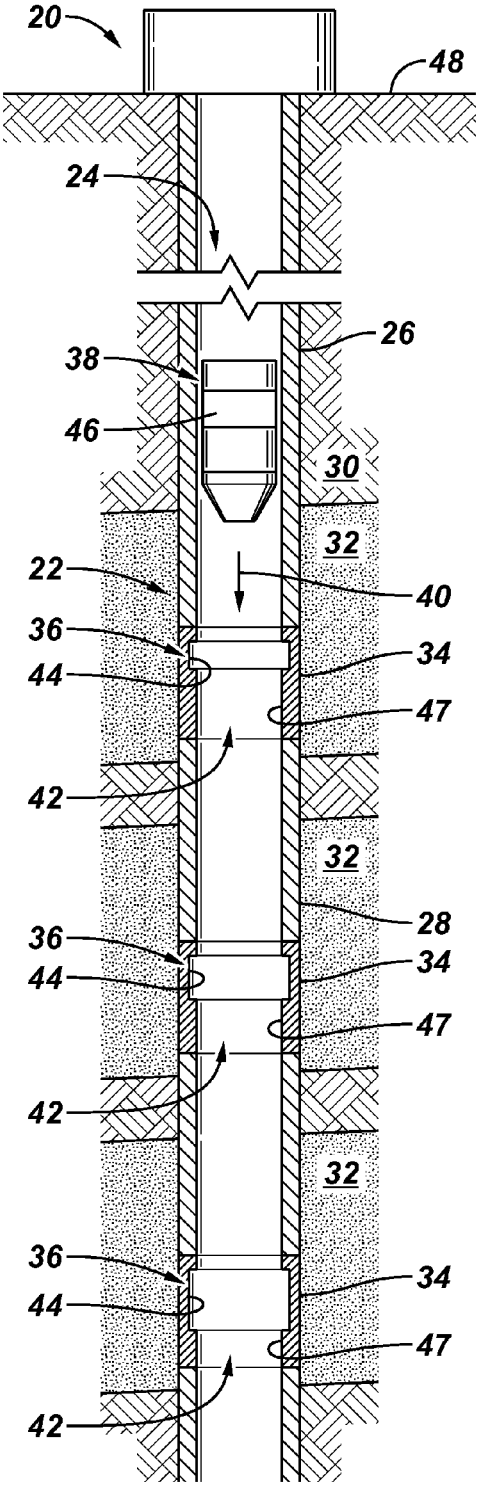
FIG. 1 is a schematic illustration of an example of a well system comprising a plurality of flow control devices that may be selectively actuated, according to an embodiment of the disclosure.

Referring generally to FIG. 1, an example of one type of application utilizing a plurality of flow control devices is illustrated. The example is provided to facilitate explanation, and it should be understood that a variety of well completion systems and other well or non-well related systems may utilize the methodology described herein. The flow control devices may be located at a variety of positions and in varying numbers along the tubular structure depending on the number of external zones to be treated.

In FIG. 1, an embodiment of a well system 20 is illustrated as comprising downhole equipment 22, e.g. a well completion, deployed in a wellbore 24. The downhole equipment 22 may be part of a tubing string or tubular structure 26, such as well casing, although the tubular structure 26 also may comprise many other types of well strings, tubing and/or tubular devices. Additionally, downhole equipment 22 may include a variety of components, depending in part on the specific application, geological characteristics, and well type. In the example illustrated, the wellbore 24 is substantially vertical and tubular structure 26 comprises a casing 28. However, various well completions and other embodiments of downhole equipment 22 may be used in a well system having other types of wellbores, including deviated, e.g. horizontal, single bore, multilateral, cased, and uncased (open bore) wellbores.

In the example illustrated, wellbore 24 extends down through a subterranean formation 30 having a plurality of well zones 32. The downhole equipment 22 comprises a plurality of flow control devices 34 associated with the plurality of well zones 32. For example, an individual flow control device 34 may control flow from tubular structure 26 into the surrounding well zone 32 or vice versa. In some applications, a plurality of flow control devices 34 may be associated with each well zone 32. By way of example, the illustrated flow control devices 34 comprise sliding sleeves, although other types of valves and devices may be employed to control the lateral fluid flow.

As illustrated, each flow control device 34 comprises a seat member 36 designed to engage a dart 38 which is dropped down through tubular structure 26 in the direction illustrated by arrow 40. Each dropped dart 38 is associated with a specific seat member 36 of a specific flow control device 34 to enable actuation of that specific flow control device 34. However, engagement of the dart 38 with the specific, corresponding seat member 36 is not dependent on matching the diameter of the seat member 36 with a diameter of the dart 38. In the embodiment of FIG. 1, for example, the plurality of flow control devices 34 may be formed with longitudinal flow through passages 42 having diameters which are of common size. This enables maintenance of a relatively large flow passage through the tubular structure 26 across the multiple well zones 32.

In the example illustrated, each seat member 36 comprises a profile 44, such as a recess, which is designed to engage a corresponding engagement feature 46 of the dart 38. By way of example, the profile/recess 44 may be designed as an annular recess sized to receive the engagement feature 46 of the specific dart 38. The profile/recess 44 may be formed in a sidewall 47 of seat member 36, the sidewall 47 also serving to create longitudinal flow through passage 42. In some applications, the recess 44 has an axial length which matches the axial length of engagement feature 46 associated with a specific dart 38. The flow control devices 34 can be arranged such that the seat member with the annular recess having the greatest axial length is positioned at the distal end of the wellbore 24. Each successive flow control device 34 (moving in a direction along wellbore 24 toward a surface location 48) has an annular recesses 44 of progressively shorter axial length. Consequently, the dart 38 having the axially longest engagement feature 46 and matching the recess 44 of the most distal flow control device 34 would be dropped first to enable treatment of the most distal well zone 32. Each sequentially dropped dart 38 would have a progressively shorter engagement feature 46 matching a progressively shorter recess 44 to enable sequential treating of the well zones 32 in a pattern moving from a distal well region to a region closer to surface location 48.

Figure 2:
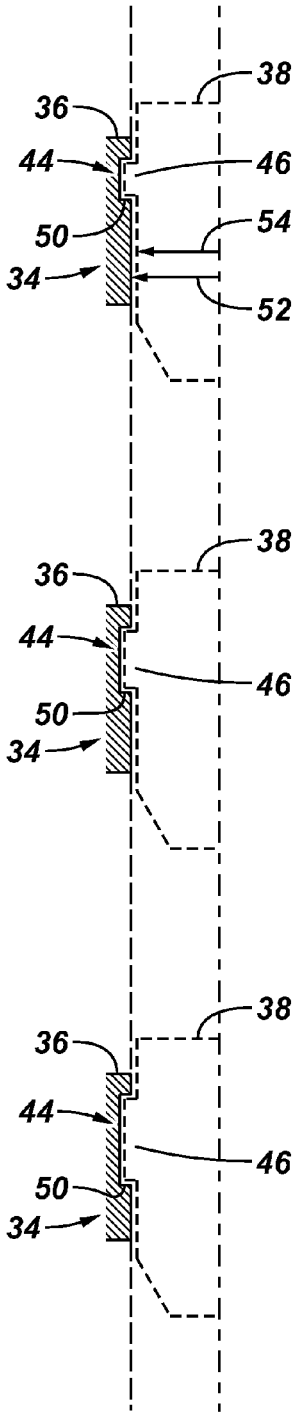
FIG. 2 is a schematic illustration of flow control devices having annularly located recesses sized for interaction with corresponding engagement features of dropped darts, according to an embodiment of the disclosure.

Referring generally to FIG. 2, a schematic example of a system and methodology for treating multiple well zones is illustrated. In this example, each flow control device 34 is actuated by movement of the seat member 36 once engaged by a corresponding dart 38. Each seat member 36 comprises profile/recess 44 in the form of an annular recess 50 with sequential seat members 36 of sequential flow control devices 34 having progressively shorter axial lengths. However, a diameter 52 of each seat member flow through passage 42 is the same from one seat member 36 to the next. This enables construction of darts 38 having a common diameter 54 when in a radially contracted configuration during movement down through tubular structure 26. However, each sequentially dropped dart 38 has its engagement feature 46 of progressively shorter length relative to the previously dropped dart 38 and sized to match the appropriate corresponding annular recess 50.

In a multizone treatment operation, the dart 38 having the engagement feature 46 with the longest axial length is initially dropped down through the tubular structure 26. Because the engagement feature is axially longer than the annular recesses 50 of the initial seat members 36, the dart 38 passes down through flow control devices 34 until the engagement feature 46 can transition radially outwardly into engagement with the lowermost seat member 36 illustrated in the example of FIG. 2. Pressure may then be applied through the tubular structure 26 and against the dart 38 to transition the seat member 36 and the corresponding flow control device 34 to a desired operational configuration. For example, the flow control device 34 may comprise a sliding sleeve which is transitioned to an open flow position to enable outward flow of a fracturing treatment or other type of treatment into the surrounding well zone 32.

Once the initial well zone is treated, a subsequent dart 38 is dropped down through the flow through passages 42 of the upper flow control device or devices until the engagement feature 46 is able to expand outwardly into engagement with the corresponding annular recess 50 which matches the profile, e.g. axial length, of the engagement feature 46. Pressure may then again be applied down through the tubular structure 46 to transition the flow control device 34 to a desired operational configuration which enables application of a desired treatment at the surrounding well zone 32. A third dart 38 may then be dropped for engagement with the seat member 36 of the third flow control device 34 to enable actuation of the third flow control device and treatment of the surrounding well zone. This process may be repeated as desired for each additional flow control device 34 and well zone 32. Depending on the application, a relatively large number of darts 38 is easily deployed to enable actuation of specific flow control devices along the wellbore 24 for the efficient treatment of multiple well zones.

Figure 3:
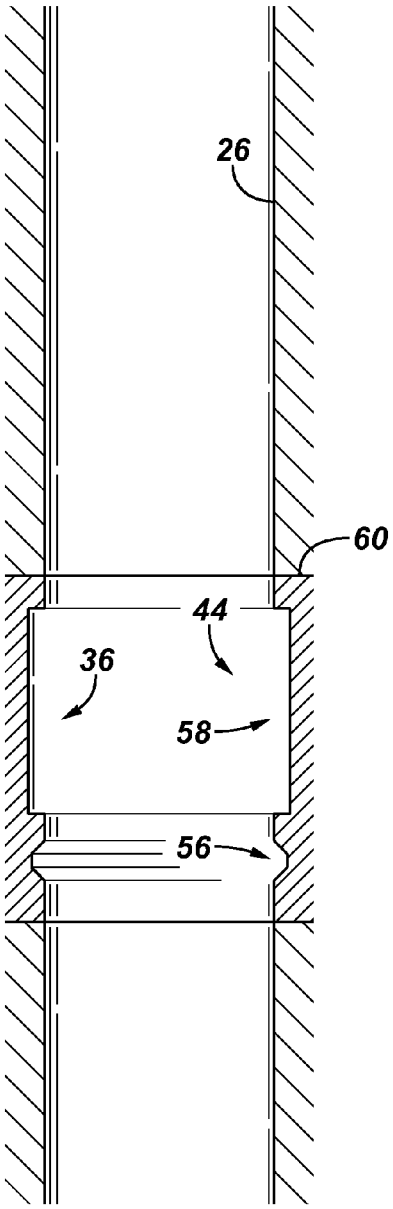
FIG. 3 is a schematic illustration of a flow control sub having a flow control device with a seat member having a unique annular profile, according to an alternate embodiment of the disclosure.

The actual design of the profile/recess 44 and of the engagement feature 46 may vary from one application to another. In FIG. 3, for example, another embodiment of the recess 44 is illustrated. In this example, the profile/recess 44 comprises an annular notch 56 axially separated from an annular recess ring 58. By way of example, the annular notch 56 may be positioned at the same location within each seat member 36. However, the annular recess ring 58 is designed with a progressively shorter axial length for each subsequent seat member 36 of each subsequent flow control device 34. In some applications, each flow control device 34 with its corresponding seat member 36 is located in a sub 60. Sub 60 may be coupled into the downhole equipment 22 to form the overall tubing string. In a fracturing operation, for example, sub 60 may comprise a frac-sub which is threaded into engagement with the adjacent tubing/structures of the overall tubing string.

Figure 4:
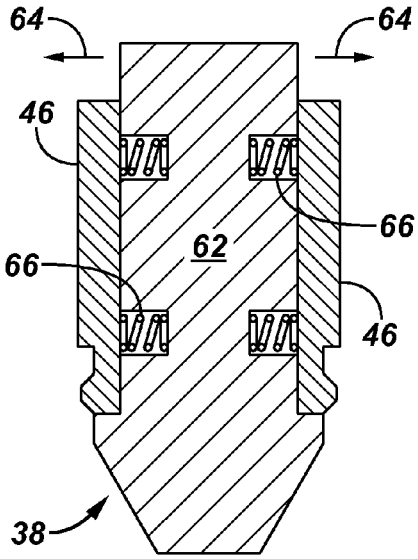
FIG. 4 is an illustration of an example of a dart designed for interaction with a specific, corresponding flow control device, according to an embodiment of the disclosure.

Depending on the design of seat member 36 and recess/profile 44, the darts 38 are constructed with a matching design. Generally, each dart 38 may comprise a dart body 62 to which engagement features 46 are movably mounted, as illustrated in the example of FIG. 4. By way of example, each dart body 62 may carry one or more engagement features 46, e.g. two engagement features, which are designed to move radially outwardly, as indicated by arrows 64 when the dart 38 passes a profile/recess 44 matching the engagement features 46. The engagement feature 46 may be spring mounted to dart body 62 via biasing members 66, e.g. springs, which bias the engagement features 46 in a radially outward direction. Thus, when dart 38 moves through a seat member 36 with a matching profile/recess 44, biasing members 66 move engagement features 46 outwardly into engagement with the corresponding recess 44 and dart 38 becomes seated in the desired seat member 36.

It should be noted that dart 38 may be constructed in a variety of configurations which may include generally cylindrical configurations, spherical configurations, or other configurations which allow radially outward movement of the engagement features 46 into engagement with a matching profile/recess 44. Biasing members 66 may comprise a variety of springs or other types of biasing members and/or materials used to transition the engagement features 46 outwardly for engagement with the corresponding recess/profile 44. Use of profiles 44, such as the annular recesses, enables construction of darts 38 having common diameters for movement through flow through passages 42 having common diameters until the dart 38 reaches the specific, corresponding flow control device 36. In some applications, the dart 38 can be designed to seal against a corresponding seal member formed of a hard rubber or other suitable material and mounted directly in a casing sub.

The darts 38 also may be formed from a variety of materials. In many applications, the darts are not subjected to abrasive flow, so the darts 38 may be constructed from a relatively soft material, such as aluminum. In a variety of applications, the darts 38 also may be formed from degradable, e.g. dissolvable, materials which simply degrade over a relatively short period of time following performance of the well treatment operation at the surrounding well zone 32. Upon sufficient degradation, the dart 38 can simply drop through the corresponding flow control device 34 to allow production fluid flow, or other fluid flows, along the interior of the tubular structure 26.

Figure 5:
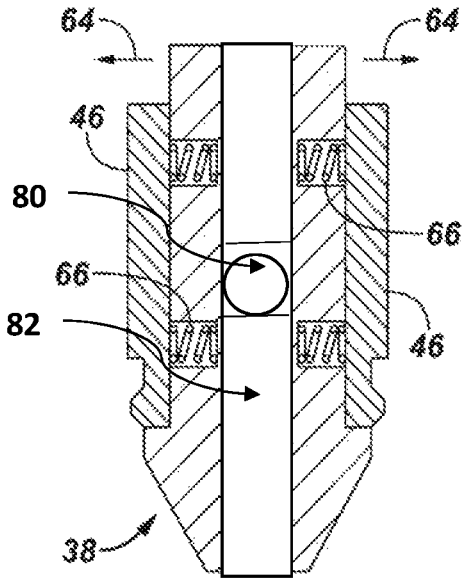
FIG. 5 is an illustration of an example of a dart designed for interaction with a specific, corresponding flow control device, with an internal flow passage and a valve according to an embodiment of the disclosure.

Depending on the application, each dart 38 may be formed with an internal flow passage 82 and check valve 80 oriented to enable pressure buildup directed in a downhole direction and to allow flow back in an uphole direction, as illustrated in FIG. 5. The check valve may be formed with a ball, plug, or other device designed to seal against a corresponding seat. The ball, plug or other suitable device also may be formed of a dissolvable material which dissolves over a suitable length of time to allow a production flow. In such an application, the internal seat and the flow passage within the dart 38 are designed with sufficient diameter to accommodate a suitable production flow without needing to remove the remaining portion of the dart 38, e.g. the dart housing. In place of a check valve, a center portion of the dart 38 also can be formed of a dissolvable material that dissolves over a certain period of time to expose a flow through passage able to accommodate production flow.

Furthermore, the system and methodology may be employed in non-well related applications which require actuation of devices at specific zones along a tubular structure. Similarly, the system and methodology may be employed in many types of well treatment applications and other applications in which devices are actuated downhole via dropped darts without requiring any changes to the diameter of the internal fluid flow passage. Different well treatment operations may be performed at different well zones without requiring separate interventions operations. Sequential darts may simply be dropped into engagement with specific well devices for actuation of those specific well devices at predetermined locations along the well equipment positioned downhole.

Although only a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method of treating a plurality of well zones, comprising:

locating a plurality of flow control devices along a well string in a well bore;

providing each flow control device with a seat member having an annular recess of a unique axial length relative to the annular recesses of the other flow control devices, wherein the plurality of flow control devices are arranged in a sequence such that the axial lengths of the annular recesses progressively decrease along the well string in a given direction;

dropping a dart with an engagement feature sized to engage the annular recess of a specific flow control device of the plurality of flow control devices;

applying pressure through the well string after the engagement feature engages the annular recess of a desired flow control device to actuate the desired flow control device to an open flow position;

stimulating a surrounding well zone after actuating the desired flow control device; and flowing via an internal valve and flow passage in the dart after stimulating the surrounding well zone, wherein the internal flow passage is formed upon dissolution of a dissolvable material of the dart.

2. The method as recited in claim 1, wherein locating comprises locating a plurality of sliding sleeves along a well completion.

3. The method as recited in claim 1, wherein providing comprises providing each flow control device with the seat member having an internal flow diameter the same as the internal flow diameters of the other seat members.

4. The method as recited in claim 1, further comprising forming the engagement feature as a spring-loaded member biased radially outward from a dart body.

5. The method as recited in claim 1, further comprising dropping a second dart with its engagement feature having a shorter axial length that the engagement feature of the dart.

6. The method as recited in claim 5, further comprising dropping a third dart with its engagement feature having a shorter axial length that the engagement feature of the second dart.

7. The method as recited in claim 1, wherein locating comprises locating the flow control devices along a tubular of a well completion.

8. The method as recited in claim 1, wherein locating comprises locating the flow control devices along a casing in the wellbore.

9. The method as recited in claim 1, wherein the internal flow passage comprises a unidirectional flow passage.

10. A system for use in a well, comprising:

a plurality of flow control devices positioned along a tubing to control flow between an interior and an exterior of the tubing, each flow control device having a seat member with a sidewall forming a longitudinal flow through passage and a lateral recess having a unique profile relative to the lateral recesses of the other seat members, wherein the plurality of flow control devices are arranged in a sequence such that axial lengths of the lateral recesses progressively decrease along the tubing in a given direction; and a plurality of darts, each dart comprising a dart body and an engagement feature uniquely sized to engage a specific lateral recess and an internal flow passage, wherein the internal flow passage comprises a check valve oriented to enable pressure buildup directed in a downhole direction and flowback of formation fluid in an uphole direction wherein the internal flow passage is formed upon dissolution of a dissolvable material of the dart.

11. The system as recited in claim 10, wherein the plurality of flow control devices comprises a plurality of sliding sleeves.

12. The system as recited in claim 10, wherein the tubing comprises a well casing.

13. The system as recited in claim 10, wherein the engagement feature of each dart is spring biased radially outward from the dart body.

14. The system as recited in claim 10, wherein the longitudinal flow through passage of each seat member has the same diameter as the longitudinal flow through passages of the other seat members, and each lateral recess has the unique profile in the form of a unique axial length.

15. A method, comprising:

providing a multizone well stimulation system with a plurality of flow control devices actuated via darts dropped to engage seat members of the plurality of flow control devices;

forming the seat members with flow through passages of common diameter and with annular recesses having axial lengths uniquely corresponding with specific flow control devices, wherein the plurality of flow control devices are arranged in a sequence such that the axial lengths of the annular recesses progressively decrease along a well bore in a given direction; and selecting a plurality of darts, each dart having an engagement feature of a length corresponding to a specific annular recess of a specific flow control device and having an internal flow passage, wherein the internal flow passage comprises a check valve oriented to enable pressure buildup directed in a downhole direction and flowback of formation fluid in an uphole direction wherein further the internal flow passage is formed upon dissolution of a dissolvable material of the dart;

dropping a first dart of the plurality of darts through at least one flow through passage and into engagement with the seat member having the specific annular recess corresponding with the engagement feature of the first dart; and applying pressure to shift the flow control device engaged by the first dart and performing a well treatment of a surrounding well zone.

16. The method as recited in claim 15, further comprising dropping a second dart of the plurality of darts through at least one flow through passage and into engagement with the seat member having the specific annular recess corresponding with the engagement feature of the second dart.

* * * * *